US006190742B1

(12) United States Patent
Wüster

(10) Patent No.: US 6,190,742 B1
(45) Date of Patent: Feb. 20, 2001

(54) LIGHT PERMEABLE PLATE OF SYNTHETIC RESIN

(76) Inventor: Heinrich Wüster, Unterm Hohen Rain 16, A-6460, Imst (AT)

( * ) Notice: Under 35 U.S.C. 154(b), the term of this patent shall be extended for 0 days.

(21) Appl. No.: 09/140,228

(22) Filed: Aug. 26, 1998

(30) Foreign Application Priority Data

Aug. 27, 1997 (AT) ..... A1444/97

(51) Int. Cl.[7] ..... A47G 1/12

(52) U.S. Cl. ..... 428/13; 428/14; 428/33; 428/34; 428/76

(58) Field of Search ..... 428/13, 14, 33, 428/34, 76; 47/26, 17, 28.1, 29

(56) References Cited

U.S. PATENT DOCUMENTS 4,021,949 * 5/1977 Niehaus et al. ..... 40/132 R
4,443,987 * 4/1984 Erb ..... 52/309
4,720,951 * 1/1988 Thorn et al. ..... 52/208

* cited by examiner

*Primary Examiner*—Deborah Jones
*Assistant Examiner*—Abraham Bahta
(74) *Attorney, Agent, or Firm*—Herbert Dubno

(57) ABSTRACT

An extruded polycarbonate highly transparent plate having outer layers bridged by ribs to define compartments in the plate running to opposite edges thereof, is formed with a frame by injection molding the frame onto the edges of the plate which have been squeezed closed in the injection mold. The frame plastic, e.g. glass fiber reinforced polystyrene has a melting point less than that of the transparent plate.

3 Claims, 1 Drawing Sheet

Fig. 1
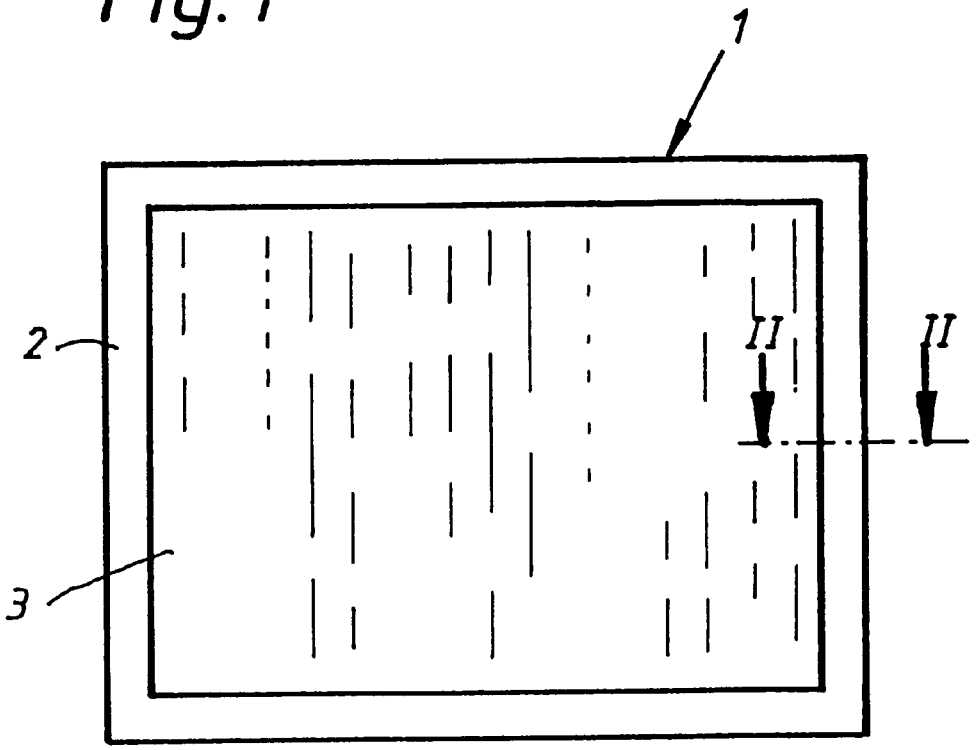
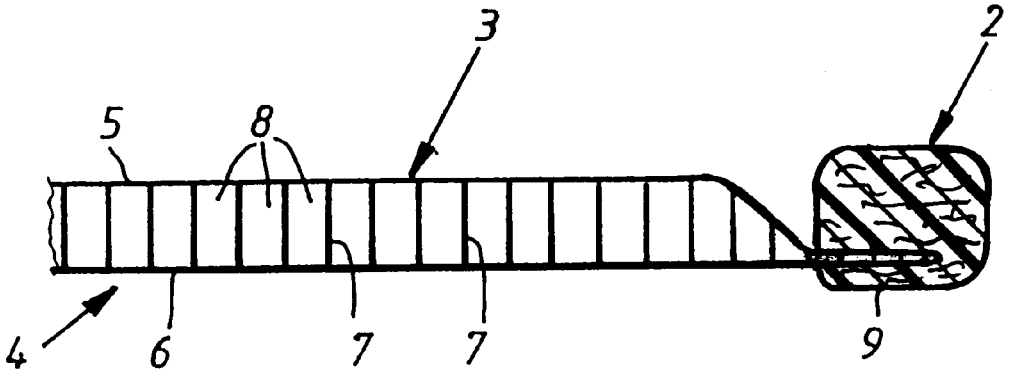
Fig. 2

LIGHT PERMEABLE PLATE OF SYNTHETIC RESIN

FIELD OF THE INVENTION

My present invention relates to a light-permeable plate element having an outer frame and a light transmissive body surrounded by that frame and composed at least in part of a light permeable hollow structure of a thermoplastic synthetic resin, preferably polycarbonate, the hollow structure being comprised of two substantially continuous outer layers bridged by webs or ribs interconnecting the outer layers and defining hollow spaces or compartments between them.

BACKGROUND OF THE INVENTION

Hollow light permeable plastic plates surrounded by a frame can be used in horticulture for green houses and so-called light frames or starting frames as a substitute for window glass which has hitherto been used for such purposes.

It is known, for example, to provide rectangular light permeable plate elements as highly transparent hollow structures of highly transparent polycarbonate within frames of U-section aluminum profiles along the longitudinal and transverse edges of the transparent member and four plastic corner pieces interconnecting the frame limbs in pairs. The frame is thus constituted from four such aluminum profiles or shapes and four plastic elements and the hollow polycarbonate plate within the frame is held in the frame or the frame elements are held on the plate by mechanical clamping.

The polycarbonate plate itself may be fabricated by extrusion and can consist of two mutually parallel spaced apart flat outer layers on thin foils, and a plurality of mutually parallel transversely spaced ribs extending in the extrusion direction and interconnecting the outer layers and spacing them apart. The extruded high-transparency hollow plate of high-transparency polycarbonate, also referred to polycarbonate structural sheets, thus include numerous ribs which extend in the longitudinal direction, are spaced apart transversely to the extrusion direction and define between them the chambers, channels or hollow spaces, also referred to as cells, of the polycarbonate structural sheet. These cells are open at the ends of the polycarbonate structural sheet, which runs transversely to the extrusion direction.

The outer layers and ribs form the cell walls or the walls of the hollow spaces and because of the cellular structure give rise to a high intrinsic stiffness. However, there are problems with attaching the aluminum shapes forming the frame to such structures because of a certain flexibility at the edges of the outer sheets.

High transparency polycarbonate hollow plates are, by comparison with glass plates of equal thickness and size, significantly lighter and practically unbreakable, while having, because of their cellular structure, a high thermal insulation capability and reduced sound transmission.

The flexible cover layer and ribs may have a wall thickness in the range of 0.001 to 0.003 mm and frequently must be connected to aluminum profiles or shapes of U-section and wall thicknesses of 0.5 to 3 mm in forming the frame. The difference in the wall thicknesses and the different mechanical properties of the polycarbonate plate on the one hand and the aluminum frame limb on the other has meant that considerable effort must be made to lock the aluminum frame limbs to the light permeable plate so that it will not loosen in use and as a result of expansion and contraction effects with rising and falling temperature and exposure to solar radiation.

In practice, that has been done by bending fingers or projections from the aluminum frame limbs and so clamping the frame limbs on the light permeable polycarbonate plates that these members can penetrate into the cover layers of the polycarbonate. The members form hooks which can serve to anchor the frame members in place.

It is also known, in providing a mechanical connection between the polycarbonate structural sheet and an aluminum frame limb to press the free ends of the shanks of the metal profile to a smaller distance than the minimum plastic thickness of the polycarbonate plate. The edges of the hollow polycarbonate plate are then compressed between the shanks, causing the elastic ribs to buckle and provide an effective interconnection.

The frame can be assembled from aluminum members and plastic corners which can have pins or studs engaging in the frame limbs and also receiving the edge regions of the hollow polycarbonate plates so that a clamping action between the aluminum limbs and the plate is enhanced by the plastic corner pieces which can project through ribs of the polycarbonate plate for greater security of the mechanical connection.

In conventional plates with such frames, the aluminum U-section limbs enclose the edges of the hollow plates and thus close the open ends thereof, however, without effective sealing of them.

In practice, it is found that condensate can form within the compartments of the place or rain can penetrate into the compartments. Moisture can accumulate and in the presence of air, microscopic spores can grow which can reduce the transparency of the plate by forming dark colored deposits. Such algae and other biological growths cannot be removed without damaging the plate and without removing the frame members. In practice, it is found that once the frame member is removed, its replacement is not possible in a convenient manner.

OBJECTS OP THE INVENTION

It is the principal object of the present invention to provide a light-permeable plate for the aforedescribed purposes whereby the drawbacks outlined above can be obviated.

Another object of the invention is to provide a framed plate of the type described which is less in danger of suffering condensate formation or discoloration from microorganism growth than earlier plate systems.

SUMMARY OF THE INVENTION

These objects and others which will become apparent hereinafter are attained, in accordance with the present invention in a light permeable plate element having an external frame, a light permeable plate within this frame and surrounded thereby along its entire perimeter and composed of a thermoplastic synthetic resin, such as a polycarbonate, the light permeable plate being formed at least in part by two cover layers interconnected by respective ribs and defining compartments between them. According to the invention, a portion of the entire periphery of the plate is formed with a one piece synthetic resin frame composed of a plastic whose melting point is lower than that of the hollow plate and which seals the edge of the hollow plate and especially the open ends of the chambers.

In other words the light permeable plate has a reinforced edge in which the compartments are sealed as will be described in greater detail hereinafter.

More specifically, these objects are attained in accordance with the invention in a light permeable structure in which the outer frame of the light permeable hollow member surrounds the entire periphery of the latter which at least in part is a plate of high-transparency thermoplastic synthetic resin, for example, a polycarbonate. The plate is formed along at least a portion of its entire periphery with a one piece bonded synthetic resin frame which is composed of a synthetic resin whose melting point is lower than that of the hollow plate and is so bonded to the edge thereof that it closes and seals the cells or chambers of the latter.

The assembly according to the invention is thus composed entirely of plastic and is a composite element in which the plastic frame is permanently joined to the plastic hollow body. The frame is not only bonded to the plate but also closes and seals the cellular plate so that during use there is no possibility of microscopic spores penetrating into the cell interiors and, further, no possibility for nutrients to enter the cells and serve as a basis for multiplication of such spores or microorganisms there within.

According to a further feature of the invention, in the edge regions, in part to close and seal the chambers, the light-permeable hollow plate is compressed along the edge region and the synthetic resin frame is injection molded directly along the compressed edge of the plate. According to another aspect of the invention the plate can have its edge region elastically compressed and the plastic frame which can be injection molded thereon can be an elastic material. In all cases it is preferred that the frame be injected as a single piece onto the plate.

Best results are obtained when the hollow plate is a high transparency polycarbonate and the synthetic resin frame injection molded onto the edge thereof is composed of a glass-fiber-reinforced polystyrene.

According to another aspect of the invention, a method of making an assembly according to the invention comprises the steps of:

fabricating a plate section of high transparency thermoplastic synthetic resin, for example, a polycarbonate, e.g. by extrusion so that compartments of the plate section open at opposite edges of the plate;

treating the plate section with hot air to dry the cells or compartments and to heat the plate section;

inserting the plate section alone or with other plate sections into an injection mold defining a frame at least in regions thereof corresponding to the open ends of the compartment and closing the mold between heated squeezing edges to compress the edges of the plate section;

closing the mold and squeezing the edge region between heated edges;

injecting a synthetic resin into the closed injection mold, the synthetic resin having a lower melting point than that of the plate section and being preferably a glass fiber reinforced UV polystyrene;

cooling the synthetic resin injected into the injection mold; and opening the injection mold and removing the one piece light-permeable plate provided with the outer plastic frame.

With this process, the cells or chambers are dried before the plate is inserted into the injection mold and therefore microscopic spores, which can be filtered out of the hot air, can be excluded from the plate which upon drying cannot sustain microorganism multiplication. The clamping of the open ends of the plate between heated edges of the injection mold and the injection molding of the plastic frame prevents spores from entering the chambers.

BRIEF DESCRIPTION OF THE DRAWING

The above and other objects, features, and advantages will become more readily apparent from the following description, reference being made to the accompanying drawing in which:

FIG. 1 is a plan view of a plate assembly in the form of a window according to the invention; and FIG. 2 is a section along the line II—II of FIG. 1 drawn to a larger scale.

SPECIFIC DESCRIPTION

The light permeable window or assembly 1 shown in FIG. 1 comprises a one piece frame 2 surrounding a hollow light permeable plate 3 and engaging the edges all around the periphery of the plate 3. The plate 3 is a light permeable hollow compartment body 4 which can be extruded from a thermoplaastic synthetic resin, for example, high transparency polycarbonate. The body 4 has two spaced apart parallel cover layers 5 and 6 unitary with and connected by mutually parallel ribs 7. The cover layers 5, 6 and the ribs 7 define between them hollow chambers or cells 8 which are open at opposite edges of the body 4.

According to the invention, the outer periphery of the body 4 all around its perimeter is flattened to form the flattened region 9, preferably between heated pressing edges which seal the body 4 and prevent spores or other contaminants from entering. These pressing members form part of the injection mold.

Onto this flattened edge region 9, a plastic frame 2 is injection molded in one piece. The plastic frame 2 further seals the edges. The plastic of frame 2 has a lower melting point than that of the plate 3 and can be a glass fiber reinforced UV stabilized polystyrene.

The body 4 can also be composed of an acrylic plastic and the frame 2 can be provided with all or any of the connecting elements required for connecting the assembly of FIG. 1 to other similar assemblies, support frames, hinges, walls or the like. Any requisite handles and actuating elements which may be required for moving the window and/or locking it in predetermined positions can also be provided on the frame. The window can be used in a greenhouse, as a plant starting frame or the like. The frame 2 in itself can be closed to increase the stiffness but it can also be composed only of two opposite frame limbs which serve to seal the open ends of the plate.

I claim:

1. A light permeable plate element comprising a highly transparent hollow light permeable plate formed of thermoplastic synthetic resin and a plastic frame tightly joined with the periphery of said plate and formed of a synthetic resin having a melting point less than that of the synthetic resin of said plate, said plate comprising a pair of outer layers bridged by a plurality of connecting ribs and defining between them a plurality of elongated compartments with opposite outer ends closed by said plastic frame at the opposite edges of said plate.

2. The plate element defined in claim 1 wherein said opposite edges of said plate are squeezed together and embedded in said plastic frame end said plastic frame is the squeezed-together plate edges.

3. The plate element defined in claim 1 wherein said highly transparent hollow light permeable plate is formed of a polycarbonate and is tightly joined on its periphery with said plastic frame formed of glass fiber reinforced UV stabilized polystyrene injection molded over the plate edges.

* * * * *